US005145460A

United States Patent [19]

Smith, Jr.

[11] Patent Number: 5,145,460

[45] Date of Patent: Sep. 8, 1992

[54] ROLLING RAMP GASKET ASSEMBLY

[75] Inventor: William M. Smith, Jr., Corunna, Ind.

[73] Assignee: CTB, Inc., Milford, Ind.

[21] Appl. No.: 645,615

[22] Filed: Jan. 25, 1991

[51] Int. Cl.[5] ..... F24F 7/007

[52] U.S. Cl. ..... 454/253; 119/16; 119/21; 454/323; 454/334

[58] Field of Search ..... 119/16, 21; 454/237, 454/250, 251, 252, 253, 260, 303, 323, 334

[56] References Cited

U.S. PATENT DOCUMENTS

| | | | |
|---|---|---|---|
| 3,694,222 | 9/1972 | Pardoel et al. | 454/253 |
| 3,741,102 | 6/1973 | Kaiser . | |
| 3,812,772 | 5/1974 | Kaiser . | |
| 3,830,146 | 8/1974 | Kaiser . | |

FOREIGN PATENT DOCUMENTS

| | | | |
|---|---|---|---|
| 915386 | 7/1954 | Fed. Rep. of Germany | 454/237 |
| 2206799 | 8/1972 | Fed. Rep. of Germany | 454/249 |
| 571225 | 9/1977 | U.S.S.R. | 119/21 |

*Primary Examiner*—Harold Joyce

*Attorney, Agent, or Firm*—Trexler, Bushnell, Giangiorgi & Blackstone, Ltd.

[57] ABSTRACT

A gasket assembly for use with a ventilation control apparatus in a building ventilation system in a building. The building ventilation system includes inlet and outlet vents and a fan. A plurality of generally narrow continuous openings are formed in a ceiling portion of the building for introducing a ventilating air flow from a first chamber into a second chamber of the building. Air flow through each opening is selectively controlled by a movable baffle device for regulating air flow through the opening into the building. The movable baffle devices are positioned over a ventilation subject, for example a livestock cage, to cooperatively create a desired ventilating air flow pattern in combination with neighboring movable baffle devices. The gasket assembly is employed with the movable baffle device to provide an extremely uniform yet suitably fresh minimum air flow through the building. The gasket assembly includes a dam portion and a curtain portion. The curtain portion channels air flow from the opening to a reduced horizontal opening defined by the dam portion, ends of the curtain portions and the movable baffle.

17 Claims, 2 Drawing Sheets

ROLLING RAMP GASKET ASSEMBLY

BACKGROUND OF THE INVENTION

This invention relates to a ventilation control apparatus including a gasket assembly for use with a building ventilation system in a building.

Current livestock ventilation apparatus have many inadequacies primarily due to the fact that such ventilation apparatus merely draw a ventilating air flow through the building. Such apparatus fail to properly control the air flow velocity, rate and direction. Attempts to control the air flow have included regulating the speed of fans employed to induce an air flow as well as employing complex electromechanical vents to regulate the air flow. Such control devices are undesirable in some circumstances due to the complexity of regulating such control devices.

For example, regulating the air flow employing only fans lacks the ability to direct air flow in specific directions through a facility or to control the velocity or volume of the air flow passing through an uncontrolled aperture. Mechanical vents were employed to regulate the direction and velocity of the air flow, however, controlling the velocity of the air flow resulted in undesired flow paths due to the mechanical characteristics of such vents.

Regulation of livestock ventilation is an important factor in raising livestock in a healthy and efficient manner. For example, in a poultry raising building it is important to ventilate all of the poultry cages to extract the dust and the odor and substance of the poultry manure from the living area, as well as provide fresh respiratory air. These requirements are also important for the health of people working in the poultry raising building.

Additionally, it is important to provide cooling air to reduce or prevent temperature stress on the livestock. However, it is also important to avoid dramatic temperature changes which may, in itself, cause temperature shock or stress to the livestock. Therefore, as well as controlling the rate, velocity, and direction, it is important to facilitate the mixing of cooler intake air with that of existing ambient air. During periods of hot weather, the combination of the air temperature and the heat produced by the livestock, may require a substantial volume of cooling air.

Essentially no cooling air is required during cold weather. Nevertheless, fresh respiratory air is still required for the health of the livestock and the workers. Under cold weather conditions a minimum fresh air supply is required but the temperature of the fresh air must be controlled to prevent temperature shock to the livestock. Available ventilation control devices are unable to controllably supply the minimum fresh air requirements without requiring additional heating of the incoming air.

An example of a ventilation control system is found in U.S. patent Ser. No. 07/622,850 to Smith, filed 12/6/90. As shown in Smith, a long generally continuous baffle member is used to regulate air flowing through an opening in the ceiling. While this system is effective at regulating ventilating and cooling air, difficulty arises in maintaining a sufficiently small gap between the ceiling and the baffle member when only a minimum supply of fresh air is required. The ventilation control apparatus is typically employed in livestock raising facilities and may extend for distances of more than 200 feet. Under these conditions, it is difficult to maintain a narrow gap when minimum air supply is required.

OBJECTS AND SUMMARY OF THE INVENTION

A general objeot of the present invention is to provide a ventilation control apparatus which provides controllably uniform fresh air to a building in which it is employed.

Another object of the present invention is to provide a gasket assembly for use with the ventilation control apparatus for controllably maintaining a minimum air flow through the ventilation apparatus.

Another object of the present invention is to selectively position movable baffle devices of the ventilation control apparatus for structuring the air flow pattern in the building in which the ventilation control apparatus is employed.

Yet a further object of the present invention is to provide a gasket assembly for use with the ventilation control apparatus for increasing the controllability of the ventilation apparatus.

Still another object of the present invention is to provide a gasket assembly for use with a ventilation control apparatus which prevents frost or ice from accumulating on the ventilation control apparatus during cold weather conditions.

Briefly, and in accordance with the foregoing, the present invention comprises a gasket assembly for a ventilation control apparatus for use with a building ventilation system in a building. The building ventilation system includes inlet and outlet vents and a fan. A plurality of generally narrow continuous openings are formed in a ceiling portion of the building for introducing a ventilating air flow from a first chamber into a second chamber of the building. Air flow through each opening is selectively controlled by a movable baffle device for regulating air flow through the opening into the building. The movable baffle devices are positioned over a ventilation subject, for example a livestock cage, to cooperatively create a desired ventilating air flow pattern in combination with neighboring movable baffle devices. A gasket assembly is employed with the movable baffle device to provide an extremely uniform yet suitably fresh minimum air flow through the building. The gasket assembly includes a dam portion and a curtain portion. The curtain portion channels air flow from the opening to a reduced horizontal gap defined by the dam portion, ends of the curtain portions and the movable baffle.

BRIEF DESCRIPTION OF THE DRAWINGS

The features of the present invention which are believed to be novel are set forth with particularity in the appended claims. The organization and manner of the operation of the invention, together with the further objects and advantages thereof, may be understood. best by reference to the following description taken in connection with the accompanying drawings wherein like reference numerals identify like elements in which:

DESCRIPTION OF THE ILLUSTRATED EMBODIMENT

Figure 1:
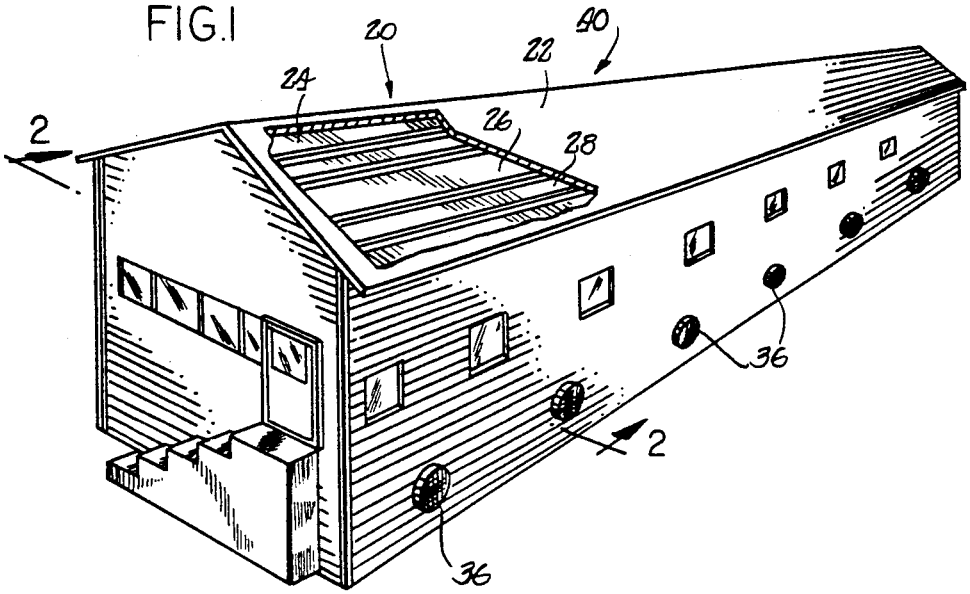
FIG. 1 is a partial fragmentary view of a livestock building in which a roof portion has been removed to illustrate top openings formed through a ceiling to permit air to flow from a first chamber into a second chamber, and out through exhaust vents along the ground level thereof.

While this invention may be susceptible to embodiment in different forms, there is shown in the drawings and will be described herein in detail, a specific embodiment with the understanding that the present disclosure is to be considered an exemplification of the principles of the invention and is not intended to limit the invention to that as illustrated.

Referring now to the drawings, wherein like parts are designated by the same reference numerals throughout the figures, a livestock building 20 is shown in FIG. 1. A portion of a roof 22 has been removed in order to more clearly show an attic space or a first chamber 24 formed between the roof 22 and a ceiling 26. Several generally narrow elongated openings 28 are formed through the ceiling 26 to permit air to pass from the first chamber 24 to a chamber below the ceiling 26.

Figure 2:
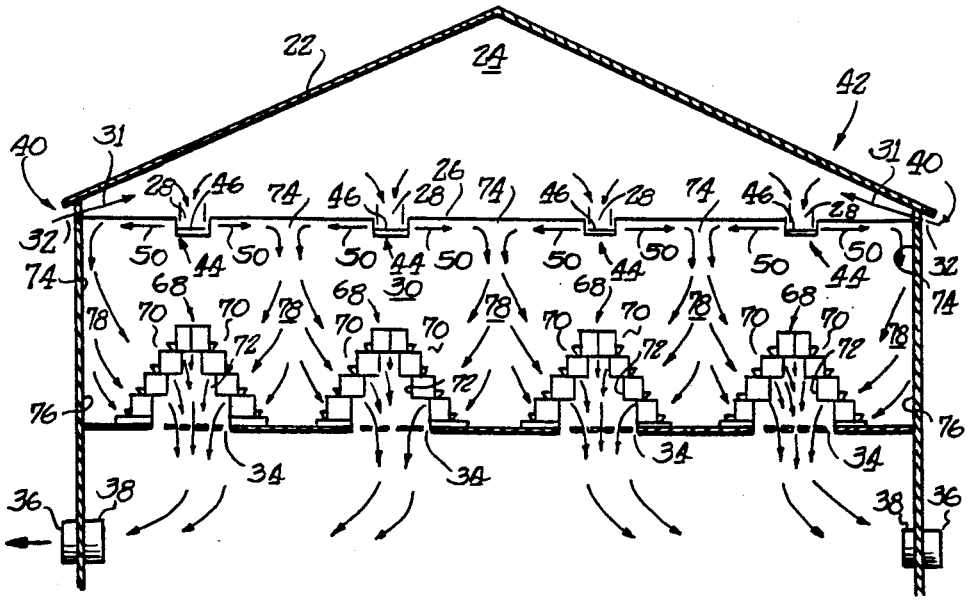
FIG. 2 is a cross-sectional view taken along 2—2 in FIG. 1 illustrating an air flow path into the first chamber, through the top openings and a respective movable baffle device into the second chamber, through outlet vents between the second chambers and out through the exhaust vents.

FIG. 2 shows a cross section of the livestock building 20 taken along lines 2—2 in FIG. 1. Clearly illustrated in FIG. 2 is the first chamber 24 and a second chamber 30 defined in an area below said first chamber 24 and separated from said first chamber 24 by the ceiling 26. The openings 28 extend from the first chamber 24 through the ceiling 26 to the second chamber 30. Ambient air 31 enters the building through inlet vents 32 and exits the second chamber 30 through outlet vents 34. Air passing from the second chamber 30 through the outlet vents 34 is exhausted through exhaust vents 36. In the present invention, fan means or air moving means 38 are positioned proximate to the exhaust vents 36 to induce an air flow through the building 20.

A simplified air flow through the, building 20 travels the following path: ambient air 31 flows from ambient atmosphere 40 outside of the building 20 through the inlet vents 32 into the first chamber 34; air in the first chamber flows through the openings 28 to the second chamber 30; and air in the second chamber flows through the outlet vents 34 to the exhaust vents 36. Movement of the air is induced by the fan means 38 which, while positioned at the exhaust vents 36 in the present invention, may be positioned elsewhere within the building structure.

Figure 3:
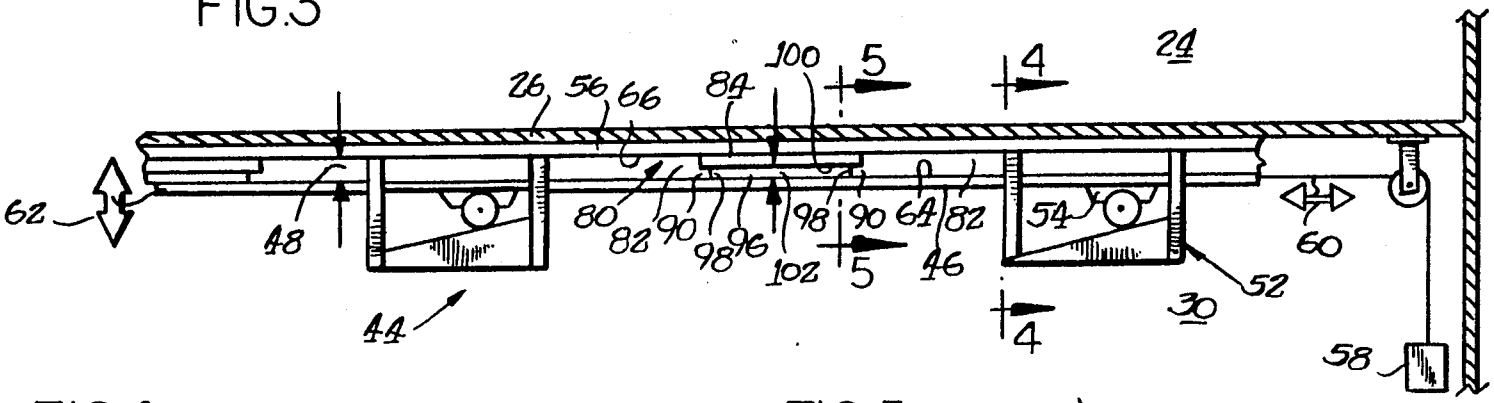
FIG. 3 is a partial fragmentary elevation view of the ventilation control apparatus including the movable baffle device, a friction reducing device and a gasket assembly.
Figure 4:
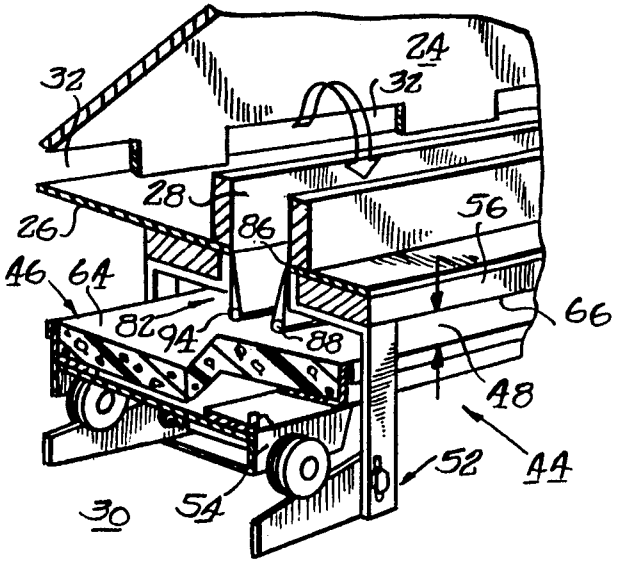
FIG. 4 is an enlarged partial fragmentary perspective view of the ventilation control device taken along line 4—4 in FIG. 3 including the movable baffle device positioned between the first and the second chambers, a curtain portion of said gasket assembly extending downwardly into the second chamber.

A building ventilation system 42 comprises the inlet and outlet vents 32, 34 the generally narrow elongated openings 28 formed through the ceiling 26, and the fan means or the air moving means 38 which induces air flow through the building 20. A ventilation control apparatus 44 is positioned proximate to one each of the openings 28 for regulating air flow through the openings 28. The ventilation control apparatus 44 includes a controllable baffle means 46 and a controllable horizontal gap 48 formed between the baffle means 46 and the ceiling 26. With reference to FIGS. 3 and 4, the baffle means 46 is a generally elongated planar member extending the length of each of the openings 28 formed through the ceiling 26. Air flowing through the opening 28 and encountering the baffle means 46 is forced through the controllable horizontal gap 48 resulting in the formation of a generally planar sheet of air 50 being emitted from the controllable horizontal gap 48. The generally planar sheet of air 50 flows away from the ventilation control apparatus 44 generally horizontal to the ceiling 26.

FIG. 3 illustrates the present invention employed with the ventilation control apparatus 44 as described hereinabove. As shown in FIG. 3, the ventilation control apparatus 44 includes the movable baffle means 46 which is supported by a friction reducing device 52 including a carriage means 54 to which the baffle means 46 are directly attached. A mounting member 56 is attached to the ceiling 26 on outside surfaces of the opening 28 to provide support for the friction reducing device 52 as well as defining the opening 28. A baffle moving means 58, of known construction, moves the carriage means 54 along the friction reducing device 52 resulting in combined horizontal movement (as shown by arrow 60) and vertical movement (as shown by arrow 62) of the baffle means 46 attached thereto. The resultant movement of the baffle means 46 increases and decreases the size of the controllable horizontal gap 48 formed between a top surface 64 of the baffle means 46 and a bottom surface 66 of the mounting member 56.

With reference to FIG. 2, a ventilation control apparatus 44 is positioned directly above a corresponding ventilation subject 68. The ventilation subject 68 has sides 70 which are fenestrated capable of passing air therethrough. The fenestrated ventilation subjects 68 are positioned over the outlet vents 34 to permit air flowing from the ventilation control apparatus to pass through the fenestrated side 70 and flow out through the outlet vents 34. The ventilation subject 68 as shown in FIG. 2 is a row of poultry cages which are stacked in a pyramidal fashion. The outside surfaces 70, as well as inside surfaces 72, are formed of a wire caging material to permit air to freely flow therethrough. Positioning the ventilation control apparatus 44 directly above the ventilation subjects 68 produces the most efficient air flow pattern. Sheets of air 50 flowing out of the ventilation control apparatus encounter an interference block 74 which forces the air downwardly toward the ventilation subject 68 and through the outlet vents 34. The interference blocks 74 as shown in the present invention include opposing sheets of air 50 as well as generally vertical inside surfaces 76 of the building 20. A downward vertical flow 78 created by the interference blocks forces air to enter the ventilation subject 68 from opposing sides thereby further enhancing positive flow from the openings 28 through the second chamber 30 and through the outlet vents 34.

Figure 5:
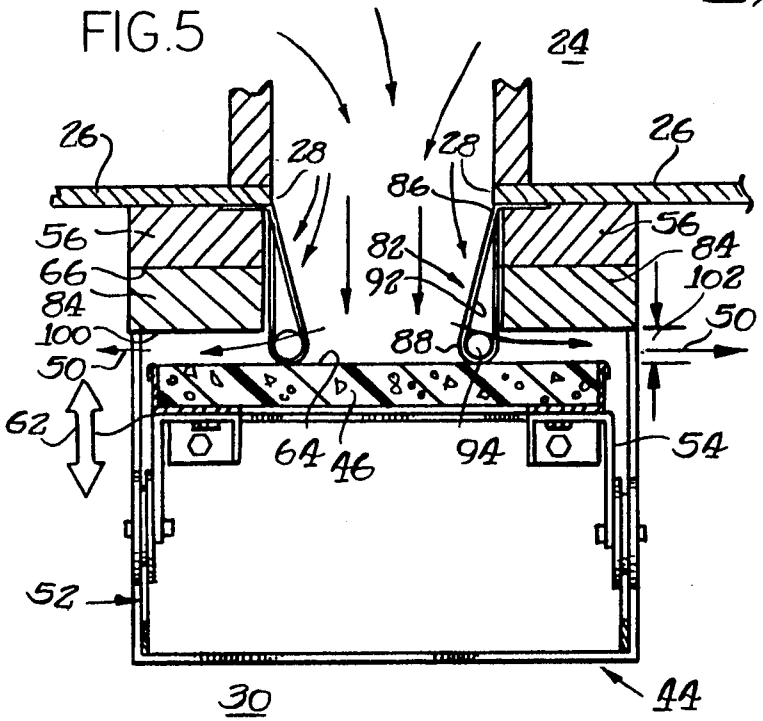
FIG. 5 is a cross-sectional view of the ventilation control apparatus taken along 5—5 in FIG. 3 showing the relationship between the curtain portion and a dam portion of the gasket assembly.

A gasket assembly 80 is shown generally in FIG. 3 and with greater detail in FIGS. 4 and 5. The gasket assembly 80 primarily includes a curtain portion 82 and a dam portion 84. The dam portion 84, as shown in FIGS. 3 and 5, is attached to the bottom surface 66 of the mounting member 56 below the ceiling 26. The curtain portion 82 has a top portion 86 and a bottom portion 88. The top portion 86 is attached to the mounting member 56, ceiling 26, or opening 28 and the bottom portion 88 hangs generally vertically downwardly therefrom. As illustrated in FIG. 5, the curtain portion 82 is attached to the ceiling 26 underneath the mounting member 56 providing secure attachment thereof. As best shown in FIG. 3, an overlapping portion 90 of the curtain portion 82 extends behind the dam portion 84. The overlapping portion 90 prevents the curtain 82 from being blown away from the dam portion 84 to enhance the flow directing function of the gasket assembly.

A sleeve 92 is formed in the curtain portion 82 for retaining weight means 94 which is retained therein. While a variety of weight means 94 may be employed to retain the curtain portion 82 in a generally vertical orientation, and such weight means 94 may be attached by various methods to the curtain portion 82, the present invention employs a generally elongated rod member positioned and retained inside of the sleeve 92. The weight means or rod member 94 has suitable weight characteristics to maintain the curtain portion 82 in a generally vertical orientation.

The dam portion 84 is a generally rigid member approximately two feet in length. The curtain portion 82 is a generally flexible body approximately six feet long having suitable characteristics for use in the present invention. During cold weather, the baffle means 46 are controllably moved into abutting contact with the bottom portion 88 of the curtain portion 82. The weight means 94 resting on the top surface 64 of the baffle means 46 creates a seal between the curtain portion 82 and the baffle means 46. The seal formed between the curtain portion 82 and the baffle means 46 forces air which would normally flow between the bottom portion 88 of the curtain portion 82 and the top surface 64 of the baffle means 46 through the nearest available opening. A reduced horizontal gap 96 provides the path of least resistance for air flowing through the opening 28. The reduced horizontal gap 96 is defined by ends 98 of the curtain portion 82 overlapping the dam portion 84, a downwardly facing surface 100 of the dam portion 84, and the top surface 64 positioned between the ends 98 of the spaced apart curtain portions 82.

While the baffle means 46 may be vertically displaced 62 downwardly from the curtain portion 82 to form a gap below the bottom portion 88 of the curtain portion 82, the reduced horizontal gap 96 reduces air flow therethrough to a minimum during cold weather. The reduced horizontal gap 96 has an area dimension which is sufficient to permit passage of a minimum ventilating air requirement therethrough. The resultant reduced horizontal gap 96 has a vertical dimension 102 which is substantially greater than a corresponding vertical dimension (not shown) measured between the mounting member 56 and the baffle means 46 which would be required if the gasket assembly 80 were not provided. In other words, the gasket assembly 80 permits substantially greater control of the minimum air supply than the ventilation control apparatus 44 without the gasket assembly 80.

The gasket assembly also reduces the possibility of a freeze up or frost formation forming in the reduced horizontal gap 96 as opposed to the controllable horizontal gap 48. For example, if the substantially smaller horizontal gap 48 were positioned to maintain minimum air supply, the gap 48 would be substantially smaller than a reduced horizontal gap 96 and would promote the formation of frost and ice in the gap thereby reducing the efficiency of the system. Further, formation of ice and frost in the gap 48 would tend to force the baffle means 46 downwardly thereby increasing the gap and failing to maintain the minimum air flow therethrough. Increased air flow because of ice build up could result in thermal shock to the livestock in the building 20 and further difficulty in maintaining control over the ventilation control apparatus 44.

The air flow patterns as illustrated in FIG. 2 will still be produced by the reduced horizontal gap 96 as long as the reduced horizontal gap 96 is positioned opposite a corresponding reduced horizontal gap 96 of a neighboring parallel ventilation control apparatus 44. Opposed reduced horizontal gaps 96 will create interference blocks 74 for each other forcing the air downwardly 78 through the ventilation subject 68 and through the outlet vents 34. The reduced horizontal gap 96 provides extremely uniform clean air flowing through the ventilation subject 68 while maintaining a minimum air supply during cold weather conditions. Further, the gasket assembly 44 permits displacement of the baffle means 46 from the curtain portion 82 to provide maximum ventilation air flow through a gap formed beneath the curtain portion and above the baffle means 46.

While a preferred embodiment of the present invention is shown and described, it is envisioned that those skilled in the art may devise modifications of the present invention without departing from the spirit and scope of the appended claims.

The invention is claimed as follows:

1. A gasket assembly for use with a ventilation control apparatus of a building ventilation system in a building; said building ventilation system including inlet and outlet vents and a fan means for moving air therethrough, at least one generally narrow elongated opening formed through a ceiling of said building for introducing ventilating air flow into said building from said inlet vent through said opening and out through said outlet vent; said ventilation control apparatus including controllable baffle means for regulating air flow through said opening, a controllable horizontal gap being formed between said baffle means and said ceiling for controllably directing air flow into said building; said gasket assembly including at least one dam portion and at least two curtain portions, said dam portion being attached to said ceiling between a ceiling facing surface of said baffle means and a baffle facing surface of said ceiling, said curtain portions being attached proximate to said opening and hanging downwardly towards said baffle means a predetermined distance from said opening, each curtain portion being spaced apart at opposite ends of said dam portion at least partially overlapping said dam portion, a reduced horizontal gap formed between said curtains, said dam, and said baffle means when said baffle means are positioned a distance from said dam and abutting said curtain portion, said reduced horizontal gap providing a minimum opening for controllably regulating air flow through said ventilation control apparatus.

2. A gasket assembly according to claim 1 wherein said dam portion is generally rigid for maintaining an upper surface of said gasket assembly and said curtain portion is generally flexible for permitting adjustment of said baffle member relative to said ceiling while contacting said curtain portion, said curtain portion overlapping an inwardly facing surface of said dam member for channeling air through said reduced horizontal gap.

3. A gasket assembly according to claim 1 wherein said curtain portion has a top portion and a bottom portion, said top portion being attached proximate to said opening and said bottom portion being positioned proximate to said baffle means, weight means being attached to said curtain generally in said bottom portion for maintaining said curtain in a downwardly directed orientation and for preventing movement of said curtain when said air flows through said opening.

4. A gasket assembly according to claim 3 wherein a horizontal sleeve is formed in said curtain portion generally parallel to said opening for retaining said weight means, said weight means comprising an elongated rod member extending through and retained in said horizontal sleeve, said rod member being formed of a material providing suitable weight characteristics to maintain said curtain in a vertical orientation.

5. A gasket assembly according to claim 1, in which said generally planar baffle means moves generally perpendicular to said ceiling to controllably cover said opening formed therethrough for regulating and directing air flow moving through said opening and is upwardly displaceable to contact said dam portion to prevent passage of air through said reduced horizontal gap.

6. An assembly for use with a ventilation control apparatus of a livestock building ventilation system; said building ventilation system including input and outlet vents and fan means for inducing air flow therethrough, a first chamber formed with said input vents therethrough in communication with a second chamber with said outlet formed therethrough, a ceiling formed between said first and second chambers, at least one generally narrow elongated opening formed through said ceiling for permitting air to flow from said input vents through said first chamber and into said second chamber, said air flowing out from said second chamber through outlet vents; said ventilation control apparatus comprising movable baffle means controllably positioned approximate to and overlying said opening for regulating air flow through said opening, said movable baffle means including a generally planar baffle member attached to movable carriage means for adjustably supporting said baffle member attached thereto approximate to said opening; a ventilation subject positioned below said baffle means, said ventilation subject having at least one fenestrated surface and being positioned over said outlet vents; a gasket assembly positioned between said first chamber and said baffle member; said gasket assembly including a dam portion and a curtain portion, said dam portion attached to said ceiling, said curtain portion abutting said baffle member directing air flow from said opening towards said dam portion, said curtain portion extending downwardly from said opening a greater distance than said dam portion, a narrowed gap formed between said dam portion, said baffle member; and said curtain portion, a sheet of ventilating air being created by air flowing from said opening through said narrowed gap, an interference block being positioned in a path of said sheet of ventilating air emitted from said narrowed gap and being spaced a distance therefrom for opposing continued horizontal movement of said sheet of air along said ceiling and for directing said sheet of air downwardly towards one of said fenestrated surfaces of said ventilation subject, said downwardly directed sheet of air passing through said fenestrated surface of said ventilation subject and through said outlet vents positioned below said ventilation subject such that uniform air flow is directed from said baffle means downwardly through said ventilating subject and out through said outlet vents positioned below said ventilating subject.

7. A gasket assembly for use with a ventilation control apparatus according to claim 6 wherein said interference block includes an opposing sheet of air emitted from a narrowed gap of a parallel neighboring baffling means, said opposing sheet of air opposing continued horizontal movement of said sheet of air along said ceiling forcing both sheets downwardly towards surfaces of respective ventilation subjects.

8. A gasket assembly for use with a control apparatus according to claim 6 wherein said interference block includes a generally vertical wall proximate to said baffle means, said generally vertical wall opposing continued horizontal movement of said sheet of air forcing said sheet of air downwardly towards a respective surface of a respective ventilation subject.

9. A gasket assembly for a ventilation control apparatus for use with a building ventilation system; said building ventilation system including a first chamber and a second chamber, a ceiling structure positioned between said first and second chambers defining said first and second chambers within a building, at least one inlet vent formed through said first chamber permitting communication between the ambient atmosphere and said first chamber, at least one generally narrow elongated opening formed through said ceiling permitting communication between said first chamber and said second chamber, at least one outlet vent formed through said second chamber permitting passage of air from said second chamber, air moving means for inducing air flow through said inlet vents to said first chamber, from said first chamber through said openings to said second chamber, and from said second chamber through said outlet vents; said ventilation control apparatus including controllably movable baffle means positioned proximate to and partially overlying said opening, said baffle means being controllably displaceable from said opening for controllably regulating air flow from said first chamber through said opening to said second chamber; a partially fenestrated ventilation subject being positioned below and parallel to said baffle means and overlying said outlet vents; said gasket assembly comprising a dam portion and a curtain portion, said dam portion being attached to one of said baffle means and said ceiling at selected locations between said ceiling and said baffle means generally parallel to a respective one of said openings, said curtain portion attached to one of said ceiling and said opening and extending downwardly toward said baffle means, a vertical dimension of said curtain being greater than a vertical dimension of said dam portion, a reduced horizontal gap being formed between said dam portion, said curtain portion, and said baffle means for channeling air flow therethrough, said reduced horizontal gap having an area of sufficient dimension for permitting passage of a minimum air flow therethrough.

10. A gasket assembly according to claim 9 wherein a bottom edge of said curtain abuts said baffle means for directing air flow from said opening through said reduced horizontal gap.

11. A gasket assembly according to claim 10 wherein an enlarged gap is formed when said baffle means are controllably displaceable downwardly away from said bottom edge of said curtain, said enlarged gap being formed between said bottom edge of said curtain and a ceiling facing surface of said baffle means for increasing air flow therethrough.

12. A gasket assembly according to claim 9 wherein a generally vertical edge of said curtain overlaps a generally vertical edge of said dam portion for focusing air flow through said reduced horizontal gap.

13. A gasket assembly according to claim 9 wherein said reduced horizontal gap has a horizontal dimension being greater than a vertical dimension for emitting a generally planar horizontal sheet of air therefrom.

14. A gasket assembly for use with a ventilation control apparatus of building ventilation system in a building; said building ventilation system including inlet and outlet vents and a fan means for moving air therethrough, at least one generally narrow elongated opening formed through a ceiling of said building for introducing ventilating air floW into said building from said inlet vent through said opening and out through said outlet vent; said ventilation control apparatus including controllable baffle means for regulating air flow through said opening, a controllable horizontal gap being formed between said baffle means and said ceiling for controllably directing air flow into said building; said gasket assembly including at least one curtain portion, said curtain portion being attached proximate to said opening and hanging downwardly towards said baffle means, a reduced horizontal gap formed in said curtain providing a minimum dimension opening for controllably regulating air flow through said ventilation control apparatus.

15. A gasket assembly according to claim 14 wherein said curtain portion has a top portion and a bottom portion, said top portion being attached proximate to said opening and said bottom portion being positioned proximate to said baffle means, weight means being attached to said curtain generally in said bottom portion for maintaining said curtain in a downwardly directed orientation and for preventing movement of said curtain when said air flows through said opening and said reduced horizontal gap.

16. A gasket assembly according to claim 14 wherein an enlarged gap is formed when said baffle means are controllably displaceable downwardly away from said bottom edge of said curtain, said enlarged gap being formed between a bottom edge of said curtain and a ceiling facing surface of said baffle means for increasing air flow therethrough.

17. A gasket assembly according to claim 14 further including an interference block, said interference block being positioned in a path of said sheet of air emitted from said reduced horizontal gap and being spaced a distance therefrom for opposing horizontal movement of said sheet of air.

* * * * *

UNITED STATES PATENT AND TRADEMARK OFFICE

CERTIFICATE OF CORRECTION

PATENT NO. : 5,145,460

DATED : September 8, 1992

INVENTOR(S) : William M. Smith Jr.

It is certified that error appears in the above-identified patent and that said Letters Patent is hereby corrected as shown below:

Column 2, Line 6 "objeot" should read — object —

Column 7, Line 24 "said outlet formed" should read — said outlet vents formed —

Column 8, Line 41 "and partially overlying" should read — and overlying —

Signed and Sealed this

Fifth Day of October, 1993

*Attest:*

*Attesting Officer*

BRUCE LEHMAN

*Commissioner of Patents and Trademarks*